United States Patent [19]

Akkerman

[11] Patent Number: 4,488,595

[45] Date of Patent: Dec. 18, 1984

[54] WELL TOOL HAVING A SLIP ASSEMBLY

[75] Inventor: Neil H. Akkerman, 15106 Beacham, Houston, Tex. 77070

[73] Assignee: Neil H. Akkerman, Houston, Tex.

[21] Appl. No.: 507,075

[22] Filed: Jun. 23, 1983

[51] Int. Cl.[3] ..... E21B 23/02

[52] U.S. Cl. ..... 166/206; 166/134; 403/371

[58] Field of Search ..... 166/206, 209, 211, 213, 166/216, 217, 119, 125, 138, 382, 387; 294/86.24, 86.25; 73/859; 411/18, 32, 33, 45, 75-80, 511; 24/263 D, 257, 129, 130, 264; 285/321, 370, 397; 403/326, DIG. 7, 371; 188/371, 74, 67

[56] References Cited

U.S. PATENT DOCUMENTS 2,127,900 8/1938 York ..... 166/211
2,736,205 2/1956 Dunne, Jr. ..... 403/371 X
3,779,314 12/1973 Read ..... 166/216
3,851,707 12/1974 Jett ..... 166/134 X

*Primary Examiner*—Ernest R. Purser
*Assistant Examiner*—Thuy M. Bui
*Attorney, Agent, or Firm*—Vaden, Eickenroht, Thompson, Bednar & Jamison

[57] ABSTRACT

There are disclosed several embodiments of a well tool having a slip assembly which is adapted to grippingly engage a cylindrical surface within a well conduit, and which includes a sleeve carried by a body adapted to be lowered into the well conduit so as to dispose a relatively high friction surface about one side of the sleeve opposite the cylindrical surface. The sleeve is split about its circumference and has end edges which extend at an angle with respect to the axis of the sleeve and are arranged to slide over one another as the sleeve is caused to move between expanded and contracted positions into and out of gripping engagement with the cylindrical surfaces.

26 Claims, 13 Drawing Figures

Fig. 9
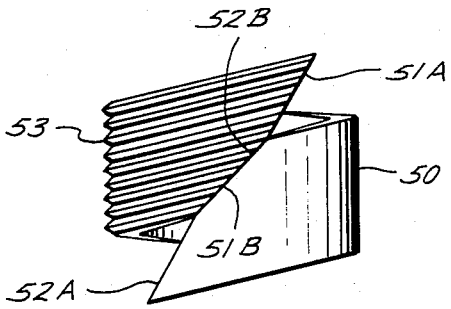
Fig. 13
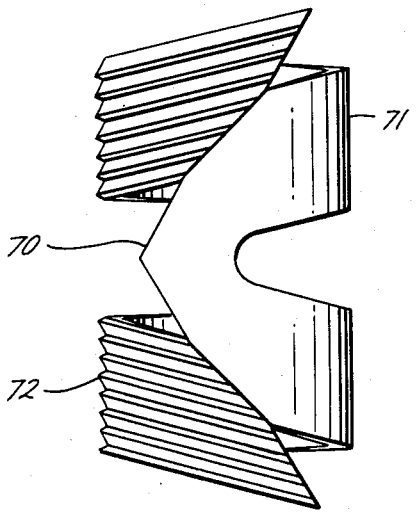
Fig. 11
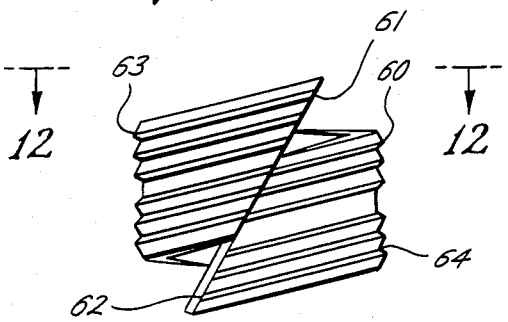
Fig. 10
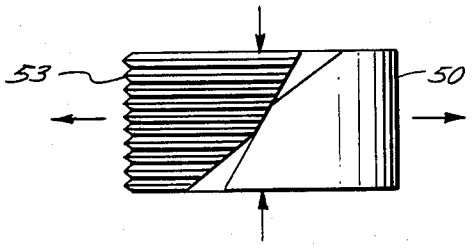
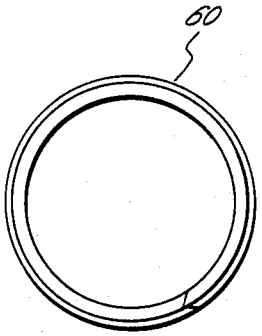
Fig. 12

WELL TOOL HAVING A SLIP ASSEMBLY

This invention relates to improvements in well tool having a slip assembly for grippingly engaging a cylindrical surface within a well conduit. In one of its aspects, it relates to a packer having a body about which the slip assembly is carried in order to anchor the packer within the well conduit.

Slip assemblies for well packers and similar tools adapted to be so anchored with a well conduit generally include a plurality of wedge-shaped slip elements carried in circumferentially spaced-apart relation about a generally conically shaped expander on the tool body. More particularly, the inner sides of the slips are slidable over complementary surfaces on the expander so as to cause teeth on their outer sides to be moved between expanded and contracted positions in response to relative axial movement of the slip elements and expander. This relative movement is normally induced by hydraulic or mechanical actuation of telescopically arranged, axially reciprocable members of the body of the tool to which the slips and expanders are connected.

In addition to the fact that they require several parts, such slip assemblies are of a complex construction requiring close tolerances between the parts. Consequently, the slip assemblies are expensive to manufacture, particularly when they include two sets of opposed slip assemblies for anchoring the tool against movement in both axial directions. Also, of course, the possibility of damage to one of the large number of parts greatly increases the possible need for retrieving the tool for repair or replacement.

Jett U.S. Pat. No. 3,851,707, and others like it assigned to Dresser Industries, Inc., show a packer having a slip assembly requiring only one slip element for preventing movement in each direction. However, that element, in addition to having compound curved surfaces which in and of themselves require precise machining, also requires machining of gripping teeth on compoundly curved surfaces. Furthermore, since the slip element must be rotated about a transverse axis in order to move into and out of gripping engagement with the well conduit, the teeth must move axially as well as radially and also in opposite axial directions on opposite sides of the slip element as they bite into and disengage from the well conduit. Still further, because the slips are mounted on a fixed axis, there is little room for error in maintaining tolerances between the slip element and the well conduit to be gripped.

The primary object of this invention is to provide a tool wherein the slip assembly also requires only one slip element for resisting movement in each direction, but in which tht slip element is of extremely simple construction which does not require precise machining, either of the element itself or of the teeth or other high friction surfaces thereon. This and other objects are accomplished, in accordance with the illustrated embodiments of the invention, by a tool in which the slip element of the slip assembly includes a sleeve which may be formed from a piece of pipe or other tubular member, and has a high friction cylindrical surface on one side which is disposable opposite the cylindrical surface in the well conduit when the sleeve is lowered with the body into the well conduit. More particularly, the sleeve has one end which may be moved in one axial direction with respect to its other end, and means on said ends which force the sleeve to move from one to another of circumferentially expanded and contracted positions, and thereby urge its high friction surface into gripping engagement with the cylindrical surface in the well conduit, as said one end is moved in said one axial direction with respect to the other end, and the body is provided with means which is operable, when the high friction surface is so disposed, to cause said one end to be so moved in said one axial direction with respect to said other end. As illustrated, the body includes means for applying oppositely directed axial forces to the sleeve for causing the ends thereof to move in opposite axial directions.

In the preferred and illustrated embodiments of the invention, the sleeve is distorted as it moves from such one to such other position so that it will automatically return to such one position upon removal of the axial forces. Also, the sleeve is circumferentially split, and the its ends have edges which are slidable over one another, as the sleeve expands and contracts, to force the sleeve to expand or contract. Preferably, end edges are slidable over one another, along a path extending at an angle with respect to the axis of the sleeve, the inclination of the angle with respect to the axis determining the extent to which the sleeve is expanded or contracted.

As illustrated, the body of the tool, which may be a packer, has axially spaced, oppositely facing shoulders, and the sleeve is carried about the body and between the shoulders, so that the shoulders may be moved in opposite axial directions to apply oppositely directed axial forces to the sleeve for expanding the sleeve, and thereby urges the high friction surface about its outer side into gripping engagement with the well conduit. If desired, the shoulders may then be moved back to their original positions to permit the sleeve to contract and the tool to be retrieved from the well conduit.

More particularly, the split sleeve resembles one convolution of a coil spring which has an inherent tendency to expand or contract as it is helically distorted in response to oppositely directed axial forces. Since its end edges overlap, during movement between such positions, the sleeve has a developed length which is greater than the circumference of the cylindrical surface to be engaged. In certain embodiments of the invention, the teeth or high friction surfaces are about the entire circumference of the sleeve. On the other hand, if the tool is to be retrievable, these surfaces may extend from one end for substantially less than the circumference of the sleeve.

Also, in one embodiment of the invention, the end edges of the sleeve include include first segments for initially moving the sleeve toward gripping engagement with the cylindrical surface of the well conduit at a relatively rapid rate, and second segments for continuing to move the sleeve at a slower rate per unit of relative axial movement of the ends of the sleeve. In this way, the sleeve may be quickly moved into a position in which its teeth are engaged with the surface, and then moved slowly but with greater mechanical advantage as the teeth bite into the surface.

In those cases in which there is a need for anchoring the tool against movement in both axial directions, such as in the case of a well packer, the tool may include two slip elements or sleeves, one comprising a slip segment with teeth arranged to resist movement in one axial direction and the other comprising a slip element having teeth arranged to resist movement in the opposite axial direction. Or, one side of the sleeve may have two sets of high friction surfaces, one arranged to resist movement in one axial direction and the other to resist movement in the other axial direction. Also, in accordance with a slip element constructed in accordance with another embodiment of the invention, one end of each sleeve is connected to one end of the other sleeve to arrange the sleeves coaxially of one another, whereby axially directed forces may be applied to the other ends of the respective sleeves to cause both of them to move substantially simultaneously into gripping engagement with the surface.

In the drawings, wherein like reference characters are used throughout to designate like parts:

FIG. 9 is an elevational view of a further embodiment of the slip assembly, which is similar to that of FIGS. 3 to 6, but wherein the slidable end edges of the sleeve are made up of first segments arranged to cause the sleeve to initially expand at a relatively rapid rate, and second segments arranged to cause the sleeve to expand at a relatively slow rate per unit of axial movement of the ends of the sleeve;

FIG. 10 is another elevational view of the embodiment of the slip assembly of FIG. 9, but upon the application of oppositely directed axial forces to its upper and lower ends, as indicated by the vertical arrows, so as to cause the slip assembly to expand;

FIG. 11 is an elevational view of a further embodiment of a slip assembly constructed in accordance with the present invention, which is similar in construction to that of FIGS. 3 to 6, but differs therefrom in that teeth are formed about substantially the entire circumference of the outer side of the sleeve, and further in that the teeth include some which are arranged to resist downward movement of the sleeve with respect to the well conduit and others which are arranged to resist upward movement of the sleeve with respect to the well conduit, when the sleeve is expanded into gripping engagement therewith;

FIG. 12 is a horizontal cross-sectional view of the sleeve of the slip assembly of FIG. 11, as seen along broken lines 12—12 thereof; and FIG. 13 is an elevational view of a still further embodiment of a slip assembly constructed in accordance with the present invention, wherein, as previously mentioned, the ends of two sleeves are connected together so as to arrange the sleeves substantially coaxially of one another, with teeth being formed on one sleeve to resist axial movement in one direction and additional teeth being formed on the other sleeve to resist axial movement in the opposite direction.

Figure 1:
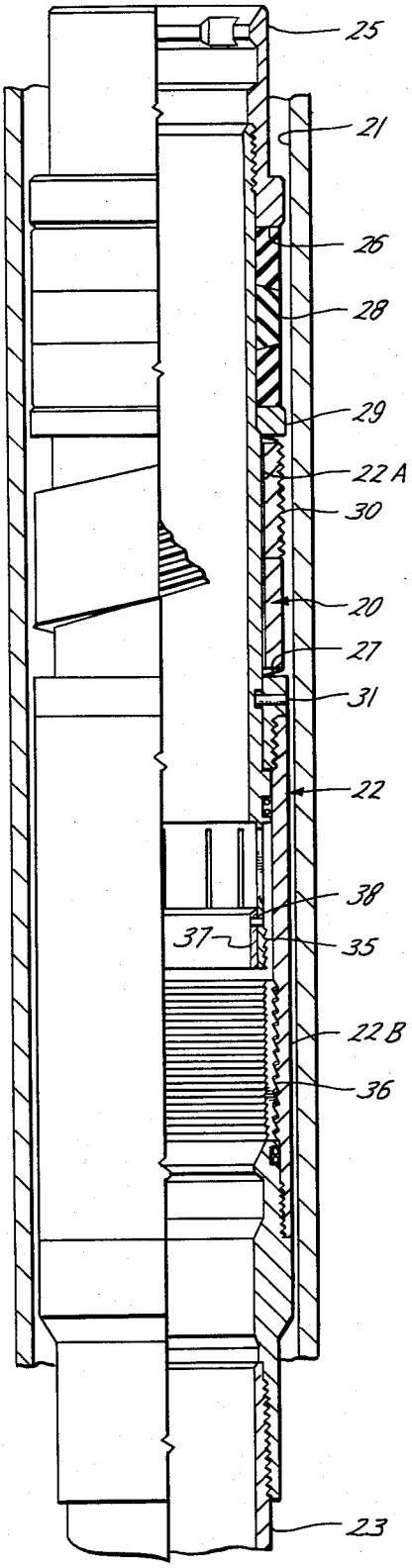
FIG. 1 is a view of a well packer, half in section and half in elevation, having a slip assembly constructed in accordance with one embodiment of the present invention, and showing the slip assembly in contracted position as the packer is lowered into a well conduit.
Figure 2:
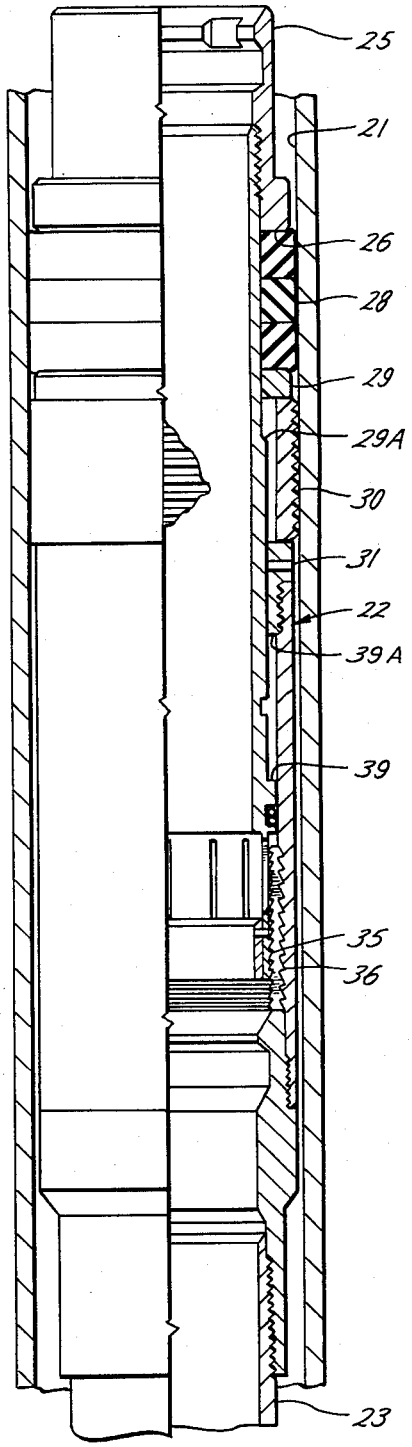
FIG. 2 is a view of the packer, similar to FIG. 1, but showing the slip assembly expanded into gripping engagement with the well conduit and the packing element of the packer expanded into sealing engagement therewith so as to set the packer.
Figure 3:
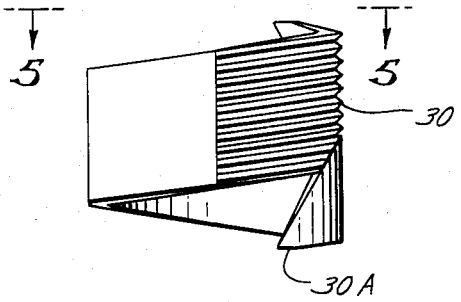
FIG. 3 is a view of one side of the slip assembly of the packer of FIGS. 1 and 2, removed from the body of the packer.
Figure 4:
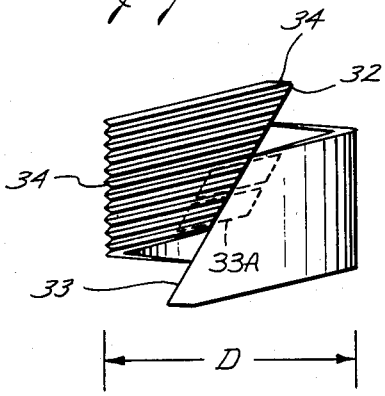
FIG. 4 is a view of the the slip assembly of FIG. 3, as seen from the front hand side thereof, and with the diameter of the slip assembly in its contracted state designated by the dimension "D"
Figure 5:
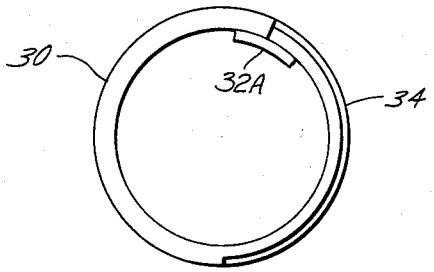
FIG. 5 is a horizontal sectional view of the slip assembly of FIGS. 3 and 4, as seen along broken lines 5—5 of FIG. 3.
Figure 6:
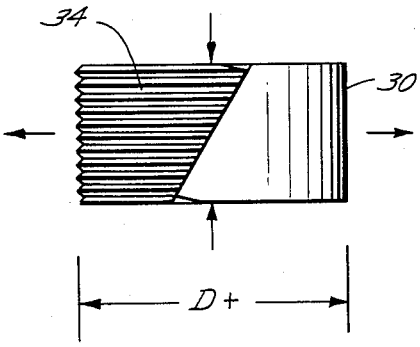
FIG. 6 is another side view of the slip assembly, similar to FIG. 4, but upon the application of oppositely directed axial forces to its ends, as indicated by vertical arrows, to expand it to an enlarged diameter designated by the dimentsion "D+"

With reference now to the details of the above-described drawings, the packer shown in FIGS. 1 and 2, and designated in its entirety by the reference 20, is disposed within a well conduit 21 which may be a well casing. The packer includes a body 22 adapted to be lowered into the well conduit on a tubing string or the like (not shown) and, as shown, having a string of tubing 23 suspended from its lower end. As well known in the art, when the packer is set to anchor it within the well bore and close off the annular space between it and the well conduit, well fluid from a production zone beneath the packer is confined for flow through the tubing string.

In the illustrated embodiment, the body 22 of the packer is made up of upper and lower, telescopically arranged members 22A and 22B which are adapted to be moved relatively to one another in opposite axial directions in order to set or unset the packer, as will be described. The upper end of tubular member 22A has a fishing neck to which the running string may be releasably connected, and the lower end of the lower member 22B is threaded for coupling to the upper end of the production string 23.

As shown, the lower end of upper tubular member 22A extends within the upper end of lower tubular member 22B, and a collar about the upper end of the upper tubular member 22A forms a downwardly facing shoulder 26 above an upwardly facing shoulder 27 on the upper end of lower tubular member 22B. A packing element 28 is carried about the upper tubular member beneath the shoulder 26 and above a ring 29 surrounding the upper tubular member above an annular seat 29A.

As noted above, the slip assembly includes a circumferentially split or discontinuous sleeve 30 disposed about the upper tubular member between the ring 29 and the upwardly facing shoulder 27 on the upper end of lower tubular member 22B. In this embodiment of the invention, the sleeve is so formed that in its normally relaxed, contracted position as shown in FIGS. 3 to 6, it assumes a helical shape, much like a convolution of a coil spring. In the extended positions of the upper and lower tubular members 22A and 22B shown in FIG. 1, the shoulders 26 and 27 are so spaced that the packing element 28 and sleeve 30 are free to assume their contracted positions in which their outer sides are generally vertically aligned with one another and the outer circumference of the packer body. During running-in of the packer, the tubular members are held in this relative axial position by means of a shear pin 31 connecting between them.

In order to expand the packing element 28 into sealing engagement with the well conduit, and the sleeve 30 of the slip assembly into gripping engagement with the well conduit, and thereby anchor the packer within the well conduit, a conventional setting tool (not shown) is lowered into the bore of the packer body so as to grip upwardly and downwardly facing shoulders on the inner diameter of the upper and lower body members. The tool may then be actuated in a well known manner to impose oppositely directed axial forces to the body members for shearing the pin 31 and causing the body members to be moved axially toward one another. Thus, as shown in FIG. 2, as the shoulders 26 and 27 are so moved, shoulder 27 raises the lower edge of one end of the sleeve to lift the upper edge of its other end into engagement with the ring 29. Continued movement of the shoulders toward one another lifts the ring 29 to expand the packer and move the ends of the sleeve toward one another so as to helically distort it into the flattened shape it assumes as it expands into engagement with the well conduit.

More particularly, the end edges 32 and 33 of the sleeve extend at an angle with respect to the axis of the sleeve and are slidable over one another as the sleeve is flattened, so as to force the sleeve to expand into gripping engagement with the well conduit, as shown in FIG. 2. More particularly, the developed length of the sleeve is greater than the inner diameter of the well conduit so that the end edges remain in contact as the sleeve expands into gripping engagement with the conduit.

As previously noted, since the sleeve is so formed as to assume a helical shape when contracted, the extent of its expansion is determined not only by the angle of the end edges which are slidable over one another, but also by its inherent tendency to expand in the manner of a convolution of a flattened helical spring. As shown, the ends of the sleeves engaged by the lower side of the ring 29 and the shoulder 27 include small flats 30A which provide a larger bearing surface, at least during the initial stages of expansion of the sleeve.

As shown, teeth 34 are formed about somewhat less than half the circumference of the outer side of the sleeve. Thus, it is contemplated, as will be described, that the packer 20 is of a type which may be unset and retrieved from the well conduit. Preferably, the teeth extend from adjacent one end of the sleeve, so that as the sleeve is compressed from its helical toward its flat shape, there is a minimum of relative movement between the teeth and the well conduit as the teeth bite into the well conduit. That is, the great majority of this relative movement will instead occur at the area of the outer side of the sleeve which is relatively slick, and in any event untoothed.

The packer is locked in its set position, and the packing element and slip ring 30 held in engagement with the well conduit upon removal of the setting tool, by means of collet fingers 35 which depend from the lower end of the upper tubular member 22A and which have ratchet teeth formed thereon for engagement with ratchet teeth on the inner diameter of a body lock ring 36 mounted within the lower tubular member 22B. As well known in the art, the body lock ring 36 is split about its circumference and has cam surfaces about its outer diameter which permit it to expand and retract as the ratchet teeth on the collet fingers move into locking engagement with ratchet teeth on its inner diameter.

When the upper and lower tubular members have been contracted to set the packer, the ratchet teeth on the lower end of the collet fingers 35 are held in locking position by means of a retaining ring 37 held in position on the inner side of the lower ends of the collet fingers by means of a shear pin 38. In order to release this locking engagement of the upper and lower tubular members, and thus permit the packer to be unset and retrieved from the well conduit, a suitable tool may be lowered into the body of the packer to apply an upwardly directed force to the lower end of the retaining ring 37 sufficient to shear the pin 38 and move the retaining ring upwardly to a position within the upper ends of the collet fingers, thereby releasing the lower ends of the collet fingers with the ratchet teeth formed thereon to move inwardly and out of locking engagement with the ratchet teeth on the inner diameter of the lock ring. Then, of course, oppositely directed axial forces may be applied to the upper and lower members of the packer body to move the shoulders 26 and 27 apart and thereby permit the packing element and sleeve 30 to return to their contracted positions.

As previously described, the stress induced in the sleeve as it is flattened from its helical shape provides the force necessary for automatically returning the sleeve to contracted position. That is, when shoulders 26 and 27 are moved apart to remove the oppositely directed axial forces from the ends of the sleeve, it will automatically asume its helical shape. At this time, a shoulder 39 about the upper tubular member is lifted into engagement with shoulder 39A about the inner diameter of the lower tubular member so as to permit the upper tubular member to lift the lower tubular member with it as the packer is retrieved.

Inasmuch as the sleeve 30 is formed of relatively thick tubular stock, it is contemplated that its end edges will not slide radially out of engagement with one another. However, in order to prevent accidental disengagement, a tab 32A secured to one end extends within the other end, and a tab 33A secured to the other end extends within the one end. In this embodiment of the invention, the tabs are relatively close to one another, when the sleeve is contracted, and then caused to move vertically apart as the sleeve is flattened into the expanded shape of FIG. 6.

It will be understood, of course, that the details of the packer above described are merely for illustrative purposes, and that the slip assembly thereof may be used in other packers, or other tools for that matter, adapted to be anchored within the well conduit or otherwise grippingly engaged with a cylindrical surface within the well conduit.

Figure 7:
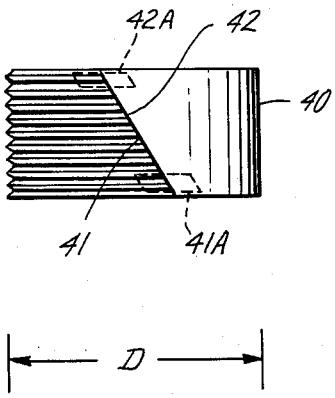
FIG. 7 is a side view of an alternative form of the slip assembly wherein the sleeve thereof, when contracted, assumes a substantially flattened configuration, haying a diameter "D"
Figure 8:
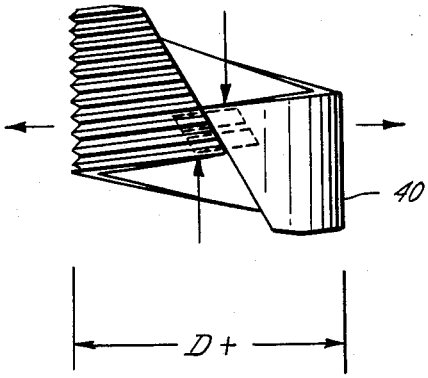
FIG. 8 is another view of the slip assembly of FIG. 7, but upon the application of oppositely directed axial forces at its upper and lower ends, as indicated by the vertical arrows, so as to expand the sleeve into a helical shape having a diameter "D+"

As shown in FIGS. 7 and 8, it is contemplated that in accordance with another embodiment of the invention, the slip assembly may comprise a sleeve 40 which differs from the sleeve 30 in that, when in its contracted state, it is substantially flat, and has end edges 41 and 42 which extend at an angle with respect to the axis of the sleeve which is essentially the revers of the angle at which the edges of the sleeve 30 extend, whereby, as oppositely directed axial forces are applied to its opposite ends to expand it, as illustrated in FIG. 8, it is distorted into a helical shape. Thus, sleeve 40 is less preferred than sleeve 30 in that it does not have the advantage of radial expansion inherent in compression of sleeve 30 from its contracted to its expanded position. In fact, in the case of the sleeve 40, the opposite would be true - i.e., movement of the sleeve from its contracted to its expanded position would contract it somewhat. However, this tendency is relatively minor in comparison to that expanding effect of the camming of the end edges of the sleeve as they slide over one another.

In any event, it will be appreciated that the slip assembly comprising the sleeve 40 may be substituted for the sleeve 30 in the packer 20, with relatively minor modifications, including axial extensions of the ring 29 and upper end of the tubular member 22B required to engage the ends of the sleeve, as indicated by the arrows of FIG. 8. In this latter regard, although the axially directed forces are preferably applied to the ends of the sleeve, since this enables the force to be applied over the maximum moment arm, it is of course possible to apply them at other locations intermediate the ends of the sleeve as long as it provides a coupling function.

In the case of this slip assembly, tabs 41A and 42A are also carried on the ends of sleeve 40 to prevent disengagement of their end edges, as described in connection with sleeve 30. However, since sleeve 40 is moved from a relatively flat to the twisted shape of FIG. 8, as it is expanded, the tops are initially vertically spaced a maximum distance in the contracted position of the sleeve (FIG. 7).

As previously noted, the slip assembly including the sleeve 50 shown in FIGS. 9 and 10 is also similar in many respects to that of FIGS. 3 to 6. Thus, the sleeve is so formed as to assume a helical shape when contracted, and has end edges which extend at an angle with respect to the axis of the sleeve and are arranged to slide over one another as oppositely directed axial forces are applied to the ends of the sleeve to cause it to expand into the position of FIG. 10. However, in the case of the sleeve 50, the end edges include segments 51A and 51B on one end for sliding over segments 52A and 52B on the other end. More particularly, and as shown in FIGS. 9 and 10, the edges 51B and 52B which are engaged with one another in the contracted position of the sleeve extend at a relatively large angle with respect to the axis of the sleeve, so that during the initial compression of the sleeve toward its flattened shape, it is caused to expand at a relatively rapid rate per unit of axial movement of the ends of the sleeve. However, the segments 51A and 52A which are arranged to slide over one another after the initial expansion of the sleeve form a lesser angle with respect to the axis of the sleeve so that, during the final movement of the sleeve into its expanded position, the rate of expansion is relatively small with respect to the rate of axial movement of the ends of the sleeve. Consequently, it is possible to expand the sleeve relatively rapidly into initial engagement with the well conduit, and then cause teeth 53 formed about part of the circumference of the ring to be forced into gripping engagement with the well conduit with greater mechanical advantage.

The slip assembly including the sleeve 60 shown in FIGS. 11 and 12 is also similar to that of FIGS. 3 to 6 in that the sleeve is so formed as to assume a helical shape when contracted, and to move into a flatter shape when expanded into gripping engagement with the well conduit. Thus, it too has end edges 61 and 62 which extend at an angle with respect to the axis of the sleeve and which are arranged to slide over one another as oppositely directed axial forces are directed against the upper and lower ends of the sleeve. However, as compared with the sleeve 30, as well as the other previously described slip assemblies, sleeve 60 has two sets of slip teeth formed about its upper circumference, each to resist axial movement in one direction. Thus, downwardly facing slip teeth 63 formed adjacent the upper end of the sleeve resist downward movement while upwardly facing teeth 64 formed adjacent the lower end thereof resist upward movement.

As previously noted, sleeve 60 also differs from those previously described in that the teeth extend about the entire circumference of the sleeve 60. Thus, this assembly would ordinarily be used with a tool which is not to be retrieved - i.e., in the case of a packer, permanently set within the well conduit. In addition, however, the provision of two sets of teeth 63 and 64 adapted to resist axial movement in opposite directions provides a slip assembly which is well suited for resisting heavy axial loads in opposite axial directions. Obviously, therefore, there may be occasions in which two sets of such teeth would be formed upon the sleeves of the previously described assemblies, wherein the teeth extend about substantially less than the entire circumference of the outer side of the sleeve. As illustrated in this embodiment, the ends of sleeve 60 are held against disengagement by one end edge 62 which is of "V" shape for fitting within a complementary shaped groove in the other end edge 61.

The slip assembly 70 shown in FIG. 13 differs from those previously described in that it includes a pair of sleeves 71 and 72, each having one end connected to one end of the other sleeve so as to arrange the sleeves substantially coaxially of one another. More particularly, downwardly facing teeth 73 are formed about a part of the circumference of sleeve 71, and upwardly facing teeth 74 are formed about a part of the circumference of sleeve 72.

In other respects, each of the sleeves 71 and 72 resembles the sleeve of FIGS. 9 and 10 in that its end edges have first and second segments arranged in the manner discussed in connection with sleeve 50. As compared with two discrete sleeves of the same construction, the sleeve 70 is of minimum height and is caused to expand both sets of teeth 73 and 74 into gripping engagement with the pipe in response to a single actuator - i.e., relatively reciprocable parts of a supporting body engageable with the upper and lower ends of the slip assembly.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A tool adapted to grippingly engage a cylindrical surface within a well conduit, comprising a body adapted to be lowered into the well conduit, and a slip assembly including a sleeve having a relatively high friction cylindrical surface on one side thereof and carried by the body for lowering therewith so that the high friction surface may be disposed opposite the cylindrical surface within the well bore, said sleeve having one end which may be moved in one axial direction with respect to its other end, and means on said ends which force the sleeve to move from one to the other of circumferentially expanded and contracted positions, and thereby urge the cylindrical surface thereof into gripping engagement with the cylindrical surface of the well conduit, as said one end is moved in said one axial direction with respect to said other end, and said body having means which is operable, when the high friction surface is so disposed, to cause said one end of the sleeve to move in said one axial direction with respect to the other end.

2. A tool of the character defined in claim 1, wherein the sleeve is split about its circumference and the means on the ends of the sleeve comprise edges which are slidable over one another.

3. A tool of the character defined in claim 2, wherein said end edges extend at an angle with respect to the axis of the sleeve.

4. A tool of the character defined in claim 1, wherein the means which causes said one end of the sleeve to move axially with respect to the other comprises means on the body for applying oppositely directed forces to said ends.

5. A tool of the character defined in claim 1, wherein the sleeve is of such construction that it is distorted as it moves from such one to such other position so that it will automatically return to such one position upon movement of said one end in the opposite axial direction relative to said other end.

6. A tool adapted to be anchored within a well conduit, comprising a body adapted to be lowered into the well conduit, a slip assembly including a sleeve having a relatively high friction cylindrical surface on one side thereof and carried by the body for lowering therewith to dispose said high friction surface opposite the well conduit, said sleeve having one end which may be moved in one axial direction with respect to its other end, and means on said ends which force the sleeve to expand in response to movement of said one end in one axial direction with respect to said other end, and means operable, when the body is so disposed, to cause said one end of the sleeve to move in said one axial direction with respect to the other in order to expand the high friction surface into gripping engagement with the well conduit.

7. A tool of the character defined in claim 6, wherein the sleeve is split about its circumference, and the means on the ends of the sleeve comprise edges which are slidable over one another.

8. A tool of the character defined in claim 7, wherein said end edges extend at an angle with respect to the axis of the sleeve.

9. A tool of the character defined in claim 6, wherein the means which causes said one end of the sleeve to move axially with respect to the other comprises means on the body for applying oppositely directed axial forces to said ends.

10. A tool of the character defined in claim 6, wherein the sleeve is of such construction that it is distorted as it is expanded so that it will automatically contract upon movement of sid one end in the opposite axial direction relative to said other end.

11. A tool adapted to be anchored within a well conduit, comprising a body adapted to be lowered within the well conduit and having axially spaced, oppositely facing shoulders, a slip assembly including a sleeve having a relatively high friction cylindrical surface on its outer side and carried about the body and between the shoulders for lowering therewith so that the high friction surfaces may be disposed opposite the well conduit, said sleeve having one end which may be moved in one axial direction with respect to the other end, and means on said ends which force the sleeve to expand in response to movement of said one end in one axial direction with respect to said other end, and means on the body for moving said shoulders in opposite axial directions with respect to one another in order to move said one end of the sleeve in said one axial direction with respect to the other and thereby expand the high friction surface into gripping engagement with the well conduit.

12. A tool of the character defined in claim 11, wherein the sleeve is split about its circumference, and the means on the ends of the sleeve comprise edges which are slidable over one another.

13. A tool of the character defined in claim 12, wherein said end edges extend at an angle with respect to the axis of the sleeve.

14. A tool of the character defined in claim 11, wherein the sleeve is of such construction that it is distorted as it is expanded so that it will automatically contract upon movement of said one end in the opposite axial direction relative to said other end.

15. A tool of the character defined in claim 11, including means for locking said shoulders in the position to which they are moved to expand the sleeve.

16. A tool of the character defined in claim 15, wherein said locking means is releasable to permit the shoulders to return toward their original position, and the sleeve is helically distorted as it is expanded so that it will automatically contract upon return movement of said shoulders.

17. A slip assembly adapted to grippingly engage a cylindrical surface within a well conduit, comprising a sleeve having a relatively high friction cylindrical surface on one side thereof which is adapted to be disposed opposite the cylindrical surface within the well bore upon lowering of the sleeve into the well conduit, said sleeve having one end which may be moved in one axial direction with respect to the other end, and means on said ends for forcing the sleeve to move from one to the other of circumferentially expanded positions and thereby urge the surface thereof into gripping engagement with the cylindrical surface of the well conduit, in response to movement of one such end in one axial direction with respect to the other end.

18. A slip assembly of the character defined in claim 17, wherein the sleeve is distorted as it moves from such one to such other position so that it will automatically return to such one position upon movement of said one end in the opposite axial direction with respect to said other end.

19. A slip assembly of the character defined in claim 18, wherein the one position is its contracted position and the one side of the sleeve is its outer side.

20. A slip assembly of the character defined in claim 17, wherein the one position is its contracted position and the one side of the sleeve is its outer side.

21. A slip assembly of the character defined in claim 17, including another sleeve having an end thereof connected to an end of the first-mentioned sleeve and arranged coaxially thereof, the high friction surfaces of the one sides of the sleeves respectively resisting relative movement between said slip element and cylindrical surface in opposite axial directions.

22. A slip assembly of the character defined in claim 17, wherein the sleeve is split about its circumference, and the means on its ends comprises end edges which are slidably engaged as the sleeve moves between expanded and contracted positions.

23. A slip assembly of the character defined in claim 22, wherein the end edges extend at an angle with respect to the axis of the sleeve.

24. A slip assembly of the character defined in claim 23, wherein the end edges of the sleeve include first segments for initially moving the sleeve toward its one position at a relatively rapid rate and second segments for continuing to move the sleeve at a slower rate per unit of relative axial movement of the ends of the sleeve.

25. A slip assembly of the character defined in claim 17, wherein the high friction surface extends about substantially the entire circumference of the one side of the sleeve.

26. A slip assembly of the character defined in claim 17, wherein the high friction surface extends from adjacent an end of the sleeve for substantially less than the circumference thereof.